United States Patent [19]

Sumiyoshi et al.

[11] 4,101,212

[45] Jul. 18, 1978

[54] IMAGE TRANSFER COMPLEMENTARY APPARATUS FOR ELECTROPHOTOGRAPHIC COPYING MACHINE

[75] Inventors: Keiji Sumiyoshi, Hino; Tomio Saitoh, Iruma, both of Japan

[73] Assignee: Konishiroku Photo Industry Co., Ltd., Tokyo, Japan

[21] Appl. No.: 759,373

[22] Filed: Jan. 14, 1977

[30] Foreign Application Priority Data

Jan. 19, 1976 [JP] Japan ..... 51-4013

[51] Int. Cl.[2] ..... G03G 15/00

[52] U.S. Cl. ..... 355/3 TR; 427/24

[58] Field of Search ..... 355/3 TR, 3 TE, 3 R; 118/638; 96/1.4; 427/24, 25; 29/121.4

[56] References Cited

U.S. PATENT DOCUMENTS

| | | | |
|---|---|---|---|
| 2,968,553 | 1/1961 | Gundlach | 355/3 R |
| 3,056,164 | 10/1962 | Reichel et al. | 29/121.4 X |
| 3,405,884 | 10/1968 | Patterson | 29/121.4 X |
| 3,659,936 | 5/1972 | Klose et al. | 355/3 R |
| 3,751,156 | 8/1973 | Szostak et al. | 355/3 TR |
| 3,795,441 | 3/1974 | Hoffman et al. | 118/638 X |

FOREIGN PATENT DOCUMENTS

| | | | |
|---|---|---|---|
| 2,443,021 | 4/1975 | Fed. Rep. of Germany | 355/3 TR |

*Primary Examiner*—Richard L. Moses

*Attorney, Agent, or Firm*—Lane, Aitken, Dunner & Ziems

[57] ABSTRACT

An image transfer complementary apparatus for an electrophotographic copying machine of the type which transfers with the use of an electrode a developed toner image onto the surface of a support material, comprising a transfer sheet depressing member in the form of a roller or a plate which forcibly depresses the transfer sheet onto the surface of a photosensitive recording element to permit a more complete and better transfer of the toner image onto the transfer sheet.

5 Claims, 4 Drawing Figures

IMAGE TRANSFER COMPLEMENTARY APPARATUS FOR ELECTROPHOTOGRAPHIC COPYING MACHINE

BACKGROUND OF THE INVENTION

1. Field of the Invention

This invention relates to an improvement of an apparatus for electrically transferring a toner image from an intermediate support surface onto a final support material, and more particularly, to an image transfer complementary apparatus for an electrophotographic copying machine.

2. Description of Prior Art

Generally in an electrostatic recording system of this type, an optical system is first utilized to form an electrostatically charged latent image, which will hereinafter be called the "latent image", on the surface of a recording element such as a photosensitive plate moving on a predetermined orbit at a predetermined speed. A developer is then contacted lightly with this latent image to form a toner image and the developed toner image is then electrostatically transferred from the plate onto the surface of an image transfer sheet by means of a transfer electrode. This transfer sheet is thereafter isolated from the surface of the recording element, and the transfer sheet carrying the toner image is eventually heated so that the toner image is melted and fixed on the transfer sheet.

The greatest factor for determining the quality of the copies obtained by the present electrostatic recording system depends upon the condition of the transferring operation of the image transfer apparatus for electrostatically transferring the toner image onto a transfer sheet transported onto the recording element.

One factor affecting the quality of the image transfer is the degree of contact between of the recording element formed with the toner image thereon and the surface of the image transfer sheet, i.e., with the transferred surface of the transfer sheet. Conventionally the recording surface is electrostatically charged to attract the transfer sheet onto the recording surface, but since such mere attracting action does not contribute sufficiently to the transferring efficiency, an improvement of this technology has been proposed by the provision of a guide plate for directing the transfer sheet which is transported from the stacked position by the sheet transporting device toward the surface of the recording element, to semi-forcibly introduce the sheet. Thus, the transferring efficiency can be considerably improved, but even this technical means inevitably tend at present to damage the recording element, or the photosensitive plate and also to abruptly lower the transferring efficiency.

SUMMARY OF THE INVENTION

This invention eliminates the aforementioned disadvantages and provides an improved image transfer apparatus which comprises an image transfer complementary apparatus mounted immediately forward of the transfer sheet transporting passage, between the recording element and the transfer electrode in an image transfer apparatus and positioned toward the recording element, for depressing the transfer sheet from the non-transferred surface of the sheet to forcibly depress the transferred surface of the sheet onto the surface of the recording element, thereby minimizing the gap between the surface of the recording element and the transfer sheet so as to effect the highest transferring efficiency of the toner image with the transfer electrode to enable the provision of complete copies.

Accordingly, it is an object of the present invention to provide an image transfer apparatus having high transfer efficiency.

It is another object of the present invention to provide an image transfer apparatus which permits more clear and complete copies.

It is still another object of the present invention to provide an image transfer apparatus which prevents wrinkling or creasing of the transfer sheet.

Further objects, features and advantages of the invention will become apparent as the invention is described more particularly hereinafter in connection with the preferred embodiments of the invention, references being had to the accompanying drawings.

BRIEF DESCRIPTION OF THE DRAWINGS

The drawings attached hereto disclose the essential components of the respective embodiments of the image transfer complementary apparatus for a electrophotographic copying machine according to this invention.

DESCRIPTION OF PREFERRED EMBODIMENTS

Figure 1:
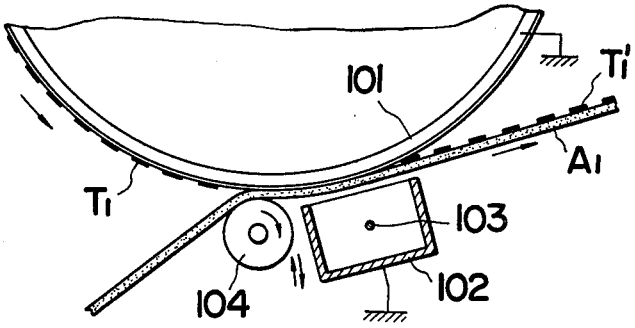
FIG. 1 is a schematic fragmentary view of a first embodiment of the image transfer apparatus of this invention.

The present invention will now be described in detail with reference to the embodiments disclosed in the drawings.

Figure 2:
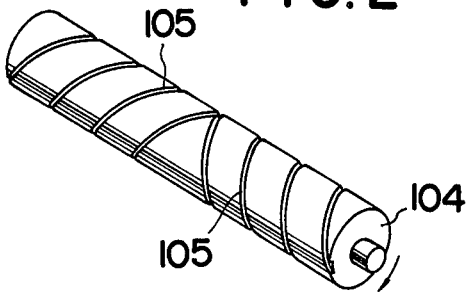
FIG. 2 is a perspective view of the depressing roller forming an essential part of the embodiment shown in FIG. 1.

In FIGS. 1 and 2, which show the essential features of a first embodiment of this invention, reference numeral 101 illustrates a recording element such as a photosensitive plate, 102 an image transfer station, 103 an image transfer electrode, and 104 a roller which constitutes an image transfer sheet depressing member. The roller 104 constitutes an essential component of the image transfer complementary apparatus of this invention, which may be a rubber roller or metal roller, and be mounted immediately before or to the left of the transfer station 102. The roller 104 forcibly depresses the image transfer sheet $A_1$ fed from a sheet stacker (not shown) by a transfer sheet transporting device (not shown) onto the surface of the recording element 101. The travel speed of the transfer sheet $A_1$, is the same as the peripheral speed of the rotating recording element 101, with the sheet being transported in the direction indicated by the arrow in FIG. 1.

The roller 104 has two sets of oppositely-directed or reverse spiral grooves 105, extending from the center thereof toward both ends on the surface thereof, in such a manner that the distances between the grooves become gradually broader as the rotation thereof further advances for the purpose of preventing wrinkles or creases being produced on the transfer sheet $A_1$ when the sheet $A_1$ is depressed onto the recording element 101.

In the operation of an electrophotographic copying machine provided with an image transfer complementary apparatus according to this invention, when the machine is started after the original receiving is placed on an original station, an electrostatically charged latent image is formed through an optical unit on the rotating recording element 101 which is uniformly electrically charged with an electrode, as is known per se, and the latent image is developed or made visible by applying thereto a finely divided toner material in conventional manners, while the transfer sheet $A_1$ separately transported by a transporting device (not shown) is forcibly depressed onto the surface of the recording element 101 by means of the image transfer depressing member or roller 104. The transfer sheet $A_1$ is thus tightly contacted with the roller 104 which while positively maintains the flatness of the sheet by or stretching the sheet with the grooves 5 formed thereon so as to transfer the image $T_1$ onto the sheet $A_1$ with the transfer electrode 103 in the electrophotographic copying machine which comprises the image transfer complementary apparatus of this invention. Accordingly, the roller 104 minimizes the gap between the surface of the recording element 101 and the surface of the transfer sheet $A_1$, thereby securing the toner image $T_1$ formed on the recording element 101 and transferred onto the image transfer sheet $A_1$, and simultaneously preventing the toner image $T_1'$ which has been transferred onto the transfer sheet $A_1$ from being deformed in shape, and thereby executing the transferring operation of the toner image $T_1$ at the transfer station 102. The transfer sheet $A_1$ carrying the transferred image $T_1'$, is then separated and transported from the surface of the recording element 101, and the image is heated, melted and then fixed according to the conventional technical means.

Figure 3:
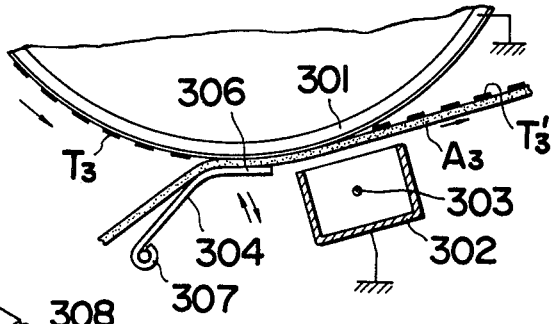
FIG. 3 is a schematic fragmentary view of a second embodiment of the image transfer apparatus of this invention.
Figure 4:
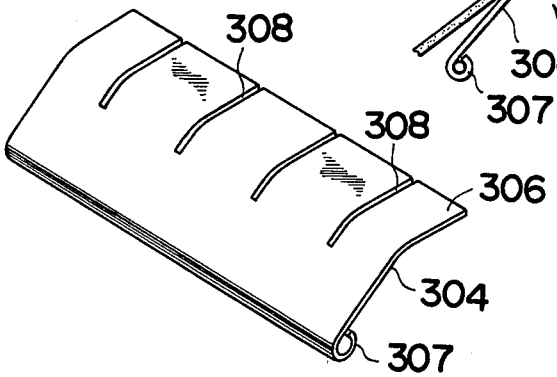
FIG. 4 is a perspective view of the depressing plate forming an essential part of the embodiment shown in FIG. 3.

FIGS. 3 and 4 show the second embodiment of this invention, wherein reference numeral 304 indicates a depressing plate as the image transfer sheet depressing member forming the essential part of the image transfer complementary apparatus of this invention, which may be made of Mylar, a trademark for a polyester plastic, phosphorus bronze of the like. The plate 304 is formed in a L-shape such that the upper portion 306 is positioned along the running surface of the recording element 301, and the lower edge portion is rockably secured to a shaft by a shaft mounting portion or journal portion 307.

As shown in FIG. 4, a plurality of slits 308 are formed in the upper portion 306 of the depressing plate 304 in a manner that the respective projected pieces integrally formed by the slits are independently deformable so as to equalize the depressing pressure or force applied to the surface of the recording element 301 by the upper portion 306 of the depressing plate 304. This provides a uniform application of the respective portions of the image transfer sheet $A_3$ onto the surface of the recording element 301.

It should be noted that if the aforementioned roller 104 and the depressing plate 304 as the image transfer sheet depressing member of the essential part of the image transfer complementary apparatus of this invention are supported to be movably separated from the surface of the recording element 101 and 301 when the image transfer sheet $A_1$ and $A_3$ are not yet supplied or transported, and are depressed on the surface of the recording element 101 and 301 as the transfer sheet $A_1$ and $A_3$ arrive at the position of the depressing member, the recording element 101 and 301 are not only protected, but the pollution of the depressing member with the developing toner is prevented, thereby eliminating of the contamination of the copies. Such support construction can be achieved by conventional means known per se.

It should be understood from the foregoing description that since the electrophotographic copying machine having the image transfer sheet depressing member of the image transfer complementary apparatus as the essential part of this invention mounted immediately before, or downstream relative to the direction of movement of the transfer sheet, the image transfer station is so constituted that the image transfer sheet is forcibly depressed from the non-transferred surface of the transfer sheet onto the surface of the recording element, thereby minimizing the gap between the surface of the recording element and the transfer sheet so as to secure the toner image from the recording element onto the transfer sheet and to simultaneously reduce considerably moving distance of the toner image from the surface of the recording element onto the surface of the transfer sheet in the transferring station to prevent the toner image from being deformed in shape. The toner image formed on the surface of the recording element is directly transferred onto the surface of the transfer sheet in its true in configuration, and is then heated, melted and fixed, with the result that the copies thus formed are greatly improved in comparison with the conventional copies obtained by the prior electrophotographic copying machine with respect to distinctness and accuracy. Clear and complete copies are obtained which could not be heretofore expected by use of the conventional electrophotographic copying machine.

Thus, this invention has further enhanced the utility of the electrophotographic copying machine of this type and has provided a copying machine of advanced performance.

What is claimed is:

1. An image transfer complementary apparatus for an electrophotographic copying machine of the type for electrically charging and exposing a recording element to form an electrically charged latent image, thereafter developing the latent image to form a toner image and transferring the toner image to a transfer sheet with a transfer electrode, comprising an image transfer sheet depressing member mounted adjacent to the image transfer sheet transporting passage defined between the recording element and the transfer electrode provided adjacent to the recording element, said member being positioned in the vicinity of the electrode for engaging the transfer sheet on the non-image receiving surface of the sheet to forcibly depress the image-receiving surface of the sheet onto the surface of the recording element, said sheet depressing member being a resilient depressing plate which has an end deformable in response to the movement of the image transfer sheet pass said plate.

2. The image transfer complementary apparatus according to claim 1, wherein said resilient depressing plate has a plurality of slits formed in said deformable end.

3. An image transfer complementary apparatus for an electrophotographic copying machine of the type for electrically charging and exposing a recording element to form an electrically charged latent image, thereafter developing the latent image to form a toner image and transferring the toner image to a transfer sheet with a transfer electrode, comprising an image transfer sheet depressing member which is mounted adjacent to the image transfer sheet transporting passage defined between said recording element and said transfer electrode provided adjacent to said recording element, the depressing member being movably disposed to be spaced from the surface of said recording element when the transfer sheet is not yet being transported to said passage, and to engage the non-image receiving surface of the transfer sheet when said sheet is being transported through said passage to forcibly depress the image-receiving surface of said sheet onto the surface of said recording element, said depressing member being a resilient plate having an end portion which is deformable in response to the movement of said sheet pass said plate.

4. The image transfer complementary apparatus according to claim 3, wherein said deformable end portion of said plate is provided with a plurality of slits.

5. In an electrophotographic copying machine having means for providing a developed toner image on the surface of a recording element and means, having a discharge electrode, for electrostatically transferring, at a transfer zone, the developed toner image to a transfer sheet supplied to the transfer zone, the improvement comprising an image transfer complementary device including a depressing plate having an end portion extending adjacent the recording element, at least the end portion of said plate being adapted to press the transfer sheet, at a position upstream of the transfer zone, against the surface of the recording element and being deformable in response to movement of the transfer sheet.

* * * * *

UNITED STATES PATENT AND TRADEMARK OFFICE

CERTIFICATE OF CORRECTION

PATENT NO. : 4,101,212

DATED : July 18, 1978

INVENTOR(S) : KEIJI SUMIYOSHI ET AL

It is certified that error appears in the above-identified patent and that said Letters Patent are hereby corrected as shown below:

Column 1, line 37, after "between" insert --the surface--.

Column 3, line 5, after "original" insert --receiving--;
line 16, delete "while";
line 17, after "by" insert --elongating--.

Column 4, line 3, delete "of the" (first occurrence)
line 20, after "considerably" insert --the--;
line 26, delete "in" (second occurrence).

Column 4, line 57 and Column 5, line 16, in each occurrence, change "pass" to --past--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*